US011976887B1

(12) United States Patent
McConnell

(10) Patent No.: US 11,976,887 B1
(45) Date of Patent: May 7, 2024

(54) HEAT EXCHANGE ARRANGEMENT FOR USE WITH A VESSEL

(71) Applicant: Philip W. McConnell, Madison, WI (US)

(72) Inventor: Philip W. McConnell, Madison, WI (US)

( * ) Notice: Subject to any disclaimer, the term of this patent is extended or adjusted under 35 U.S.C. 154(b) by 212 days.

(21) Appl. No.: 17/507,284

(22) Filed: Oct. 21, 2021

Related U.S. Application Data

(60) Provisional application No. 63/214,509, filed on Jun. 24, 2021.

(51) Int. Cl.
*F28D 7/16* (2006.01)

(52) U.S. Cl.
CPC ..... *F28D 7/163* (2013.01)

(58) Field of Classification Search
CPC ..... F28D 7/163; F28D 7/0016; F28D 7/1615; F28D 1/06; F28D 2001/0293; F28D 7/0033; F28D 21/0007; F28F 2225/04; F28F 2013/006
USPC ..... 165/157
See application file for complete search history.

(56) References Cited

U.S. PATENT DOCUMENTS 4,098,261 A * 7/1978 Watt ..... F28F 13/00 165/171
4,206,805 A 6/1980 Beckett
4,437,418 A * 3/1984 Guillaume ..... F23G 5/46 432/116
7,216,696 B2 * 5/2007 Ferraro ..... F24D 12/02 165/163
8,080,207 B2 * 12/2011 Lomax ..... F28D 7/024 422/220
9,010,407 B2 * 4/2015 Mackenzie ..... E03C 1/00 165/170
10,314,202 B2 * 6/2019 Ahamed ..... H05K 7/20509
10,935,321 B2 * 3/2021 Rule ..... F28D 1/0213
2006/0011149 A1 * 1/2006 Stevens ..... F28D 1/06 122/19.2
2011/0162641 A1 * 7/2011 Bitter ..... F24S 10/755 29/428
2013/0276777 A1 * 10/2013 Reis ..... F24S 10/75 126/661

FOREIGN PATENT DOCUMENTS

WO WO-2015180665 A1 * 12/2015 ..... F24H 9/00

* cited by examiner

*Primary Examiner* — Jon T. Schermerhorn, Jr.
(74) *Attorney, Agent, or Firm* — Andrew S. McConnell

(57) ABSTRACT

A tank-type heat exchanger includes inlet and outlet manifold and a series of heat exchange tubes that extend between the inlet manifold and the outlet manifold. The heat exchange tubes generally resemble ribs, each of which extends about a majority of the periphery of the tank and correspond in shape to the outer wall of the tank. The ribs lie in generally parallel planes. Optional heat transfer enhancer members, which may be in the form of a series of heat transfer enhancer plates, are engaged against the tank and overlie the ribs to facilitate heat transfer.

9 Claims, 4 Drawing Sheets

HEAT EXCHANGE ARRANGEMENT FOR USE WITH A VESSEL

CROSS-REFERENCE TO RELATED APPLICATIONS

This application claims the benefit of U.S. provisional patent application Ser. No. 63/214,509 filed Jun. 24, 2021, the entire disclosure and content of which is hereby incorporated by reference.

BACKGROUND AND SUMMARY

Heat exchangers are commonly defined as devices that are used to transfer thermal energy from one fluid or medium to another fluid or medium without mixing the two fluids or media. A heat exchanger may prevent mixing of the fluids by separating them through various means, often by a solid wall or heat transfer surface, usually made of material with high thermal conductivity. In some cases, using a single wall to separate the fluids is deemed insufficient for safety or other reasons and an additional wall is added, resulting in a double wall heat exchanger. This is a common arrangement used when a non-potable fluid is used to heat a potable fluid, often potable water. Heat transfer surfaces can be arranged in many forms including but not limited to pipes, tubes, plates, and tanks. Further, heat transfer surfaces can be incorporated within other tanks, vessels, components, or assemblies, often referred to as internal heat exchangers. Heat exchangers may also be attached or connected to the exterior of a tank, vessel, component, or assembly, often referred to as external heat exchangers. This invention relates to a heat exchange arrangement, and more particularly to a double-wall, external heat exchanger for use with a tank or vessel.

Various types of heat exchange arrangements are known in the art. In some, heat transfer takes place within the interior of a vessel, such as a tank. In others, heat transfer takes place on the exterior of a tank. In an external heat exchange arrangement such as this and in the case of a single-wall heat exchanger, heat is transferred between the tank walls and a heat transfer medium located outside of, and typically in contact or close proximity to, the tank walls. In a common application, the tank walls are heated to an elevated temperature by the heat exchange fluid, and heat from the tank walls is transferred to the fluid contained within the tank. In the case of a double-wall external heat exchanger, heat from the heat exchange medium transfers to the first wall of the heat exchanger, then to the tank walls, and ultimately to the fluid contained within the tank.

Some heat exchangers are purposely designed to transfer heat from a dedicated heat source to another fluid or other medium. These heat exchangers may be found in assemblies that contain their own (internal) heat source, and may be referred to as direct heat exchangers. Other heat exchangers are used in assemblies that do not contain their own heat source, but rely on another (external) source of heat and may be referred to as indirect heat exchangers. Indirect heat exchangers may also be used to capture waste heat from a separate process that generates heat, such as a refrigeration system, turbine, or motor, rather than a dedicated heat source. This type of heat exchange arrangement is often known as a waste heat recovery system or heat reclaim system. One embodiment of the present invention is as a heat reclaim system used to heat potable water with waste heat from a refrigeration system.

In a prior art design, a double-layer heat transfer cylinder is positioned about the tank exterior. The double-layer cylinder may be formed of a pair of metal sheets that are welded together along their outside edges (periphery) other than at fluid connection ports and then spot welded together at spaced-apart horizontal and vertical locations throughout the surface area of the sheets to form a plate, commonly referred to as a pillow plate heat exchanger. Pressurized gas is then introduced between the sheets to slightly inflate the space between the metal sheets, which separates them other than at the weld locations to create a flow path for fluid. The plate is then formed into a cylindrical shape and positioned so as to surround the tank, with the exterior of the tank wall being in contact with the inner surface of the pillow plate heat exchanger. A heat reclaim system of this type functions satisfactorily, but requires specialized equipment to manufacture and presents numerous potential locations for fluid leakage. In addition, a pillow plate heat exchanger such as this is may be effectively limited in use by the internal pressure of the fluid it can safely tolerate without bursting. In the case that high pressure refrigerant gas is used as the heat transfer medium within the plate, the internal pressure will depend on several factors, including the type of refrigerant used. Many common refrigerants operate at high-side pressures of 400-450 psi or less.

Another type of indirect heat exchanger known in the art employs a spiral-formed tube, A heat exchanger of this type provides a single, continuous flow path between a single inlet and a single outlet, which may result in restricted flow of the fluid exchange medium due to the length of tube required to adequately transfer heat.

In the case of heat exchangers designed to use refrigerant as a heat transfer fluid, operating pressures are a critical design parameter. Some refrigerants operate at pressures above 400-450 psi, and in the case of CO2 refrigerant (R-744), well above that pressure. For example, a typical refrigeration system using CO2 as the refrigerant may have high-side pressures as high as 2000 psi. A pillow plate heat exchange system as described above is generally considered incapable of withstanding pressures of this magnitude. Further, a large refrigeration system may contain more refrigerant than either a pillow plate or spiral-formed heat exchanger could effectively accommodate without excess restriction of the fluid, resulting in a negative impact on the connected refrigeration system.

It is an object of the present invention to provide a tank-type double wall external heat exchange arrangement that is capable of withstanding the high pressures associated with high-pressure refrigerants such as CO2, It is another object of the present invention to provide such a heat exchange arrangement that is relatively simple in its construction, yet which provides efficient transfer of heat from the refrigerant fluid, Another object of the present invention is to provide high volume refrigerant flow through the heat exchanger so as to reduce restriction as refrigerant flows through the heat exchanger.

In accordance with one aspect of the present invention, a heat exchange arrangement for use with a tank includes an inlet manifold, an outlet manifold, and a series of heat exchange tubes that extend between the inlet manifold and the outlet manifold. Representatively, the inlet manifold and the other manifold are in the form of an inlet tube and an outlet tube, respectively, which may be generally parallel and spaced apart from each other. In one embodiment, the tank extends along a longitudinal axis, and the inlet manifold and outlet manifold are oriented generally parallel to the longitudinal axis of the tank.

The heat exchange tubes generally resemble ribs, each of which extends about a majority of the periphery of the tank.

The ribs are shaped so as to correspond in shape to the outer wall of the tank. In a typical application, the tank is generally cylindrical, such that the ribs are arcuate and have an inside radius that corresponds to the outside diameter of the tank wall. The ribs may be arranged so as to lie in generally parallel planes.

The heat exchange arrangement also includes optional heat transfer enhancer members, which may be in the form of a series of heat transfer enhancer plates. Each heat transfer enhancer plate is also formed so as to correspond in shape to the outer wall of the tank. Again, in a typical application, the tank is generally cylindrical and each heat transfer enhancer plate has an inside radius that corresponds to the outside diameter of the tank wall. Each heat transfer enhancer plate overlies one of the heat exchange tubes, and representatively has a channel or groove within which the heat transfer tube is received. Each heat transfer enhancer plate may include a pair of walls that extend in opposite directions from the channel or groove, which are configured to engage the outer surface of the tank wall for facilitating heat transfer.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements can be several views, and in which.

Figure 1:
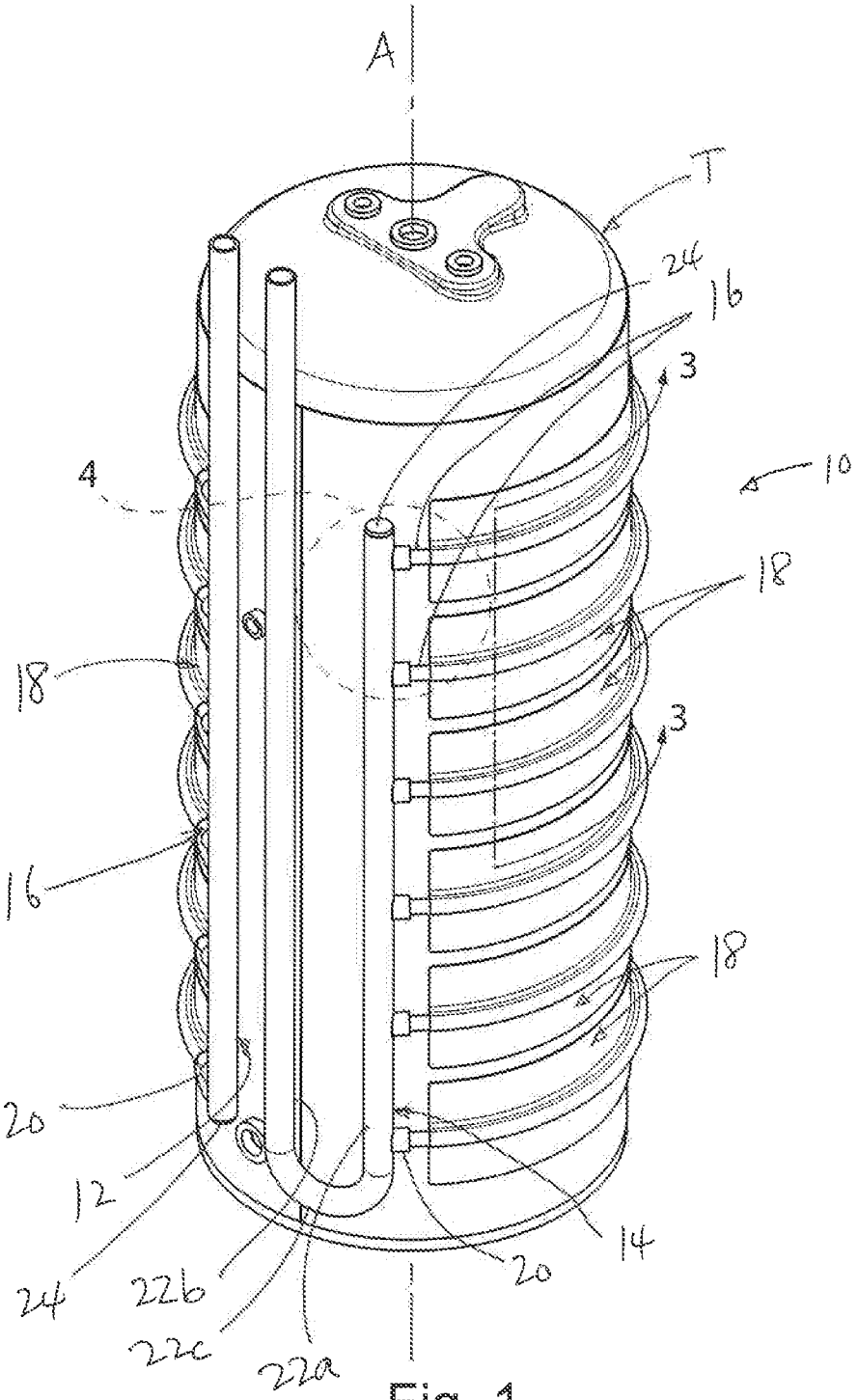
FIG. 1 is an isometric view illustrating an external tank-type heat exchange arrangement in accordance with the present invention.
Figure 2:
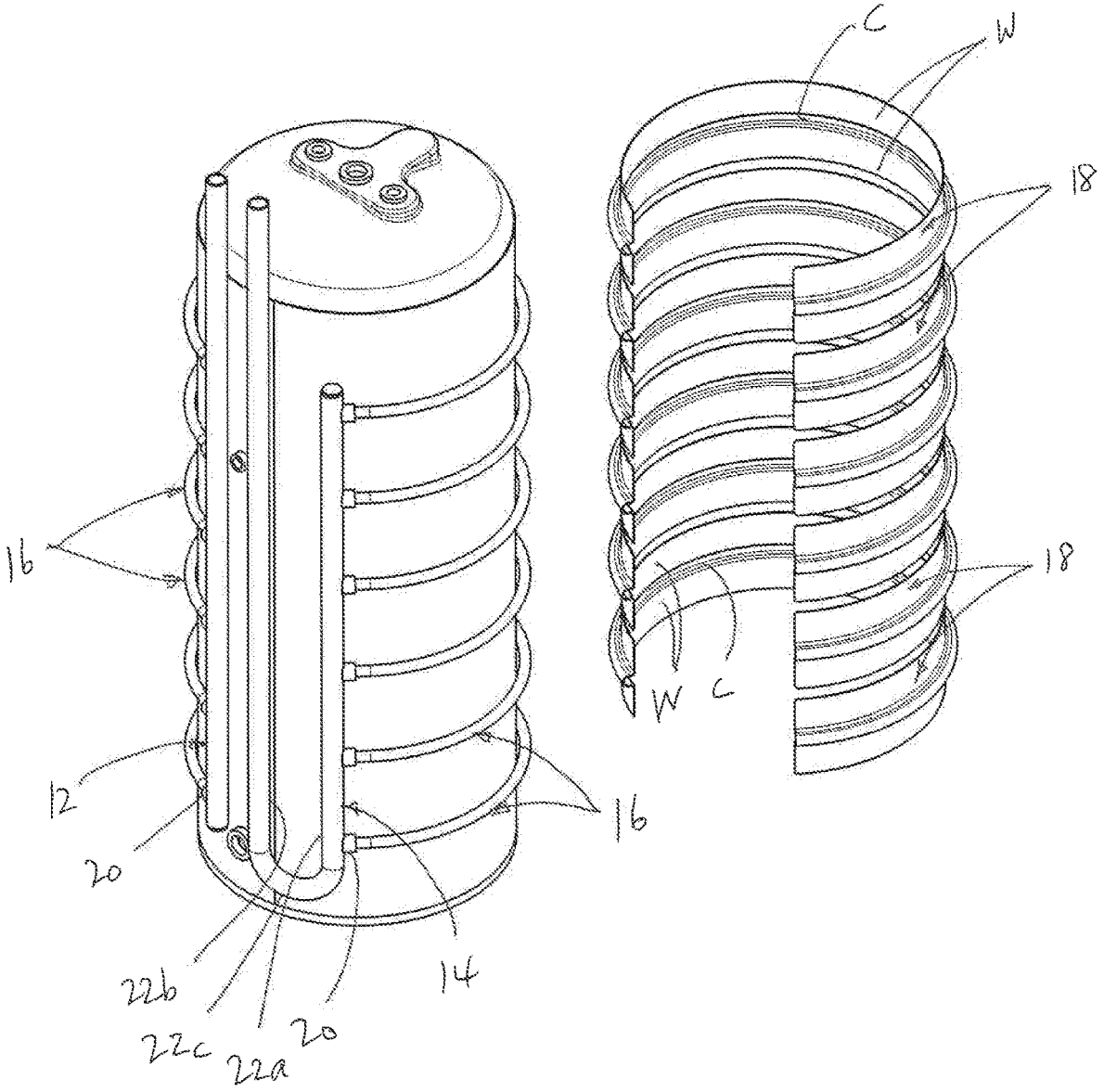
FIG. 2 is an exploded isometric view showing the components of the external tank-type heat exchange arrangement of FIG. 1.
Figure 3:
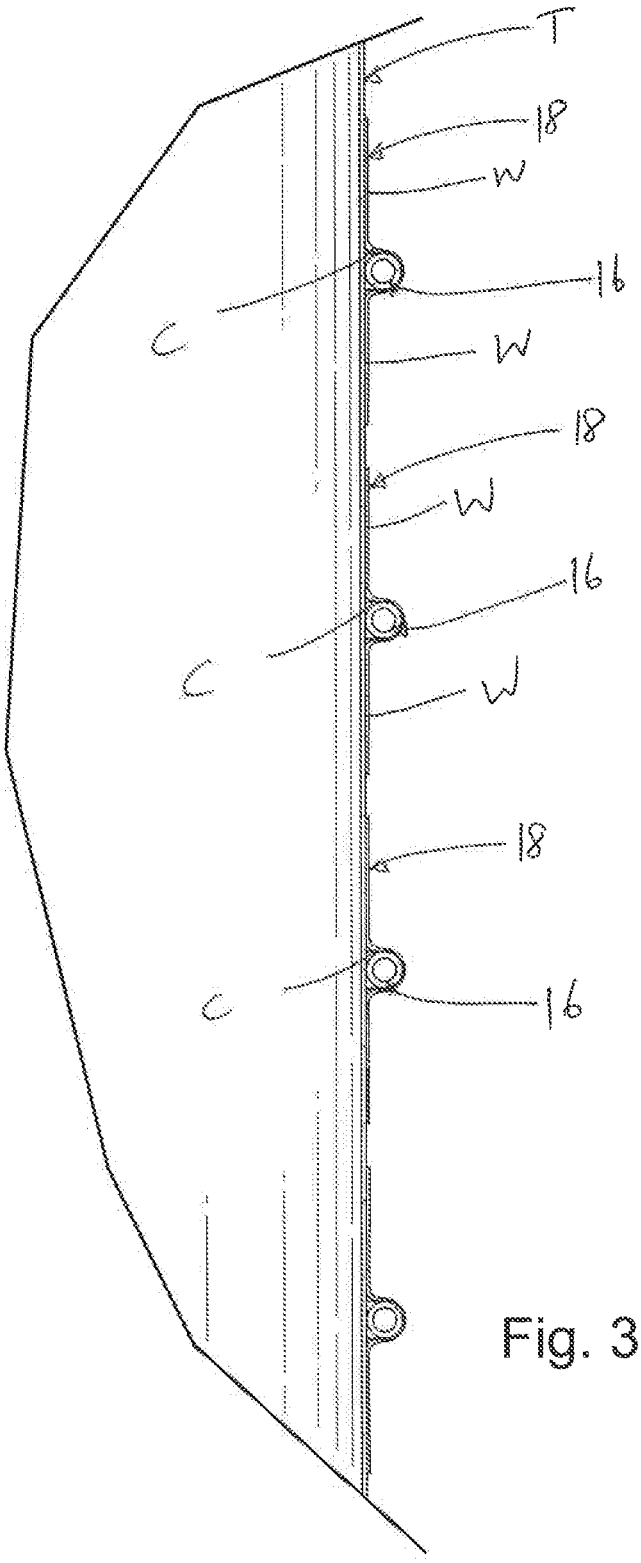
FIG. 3 is a partial section view taken along line 3-3 of FIG. 1.
Figure 4:
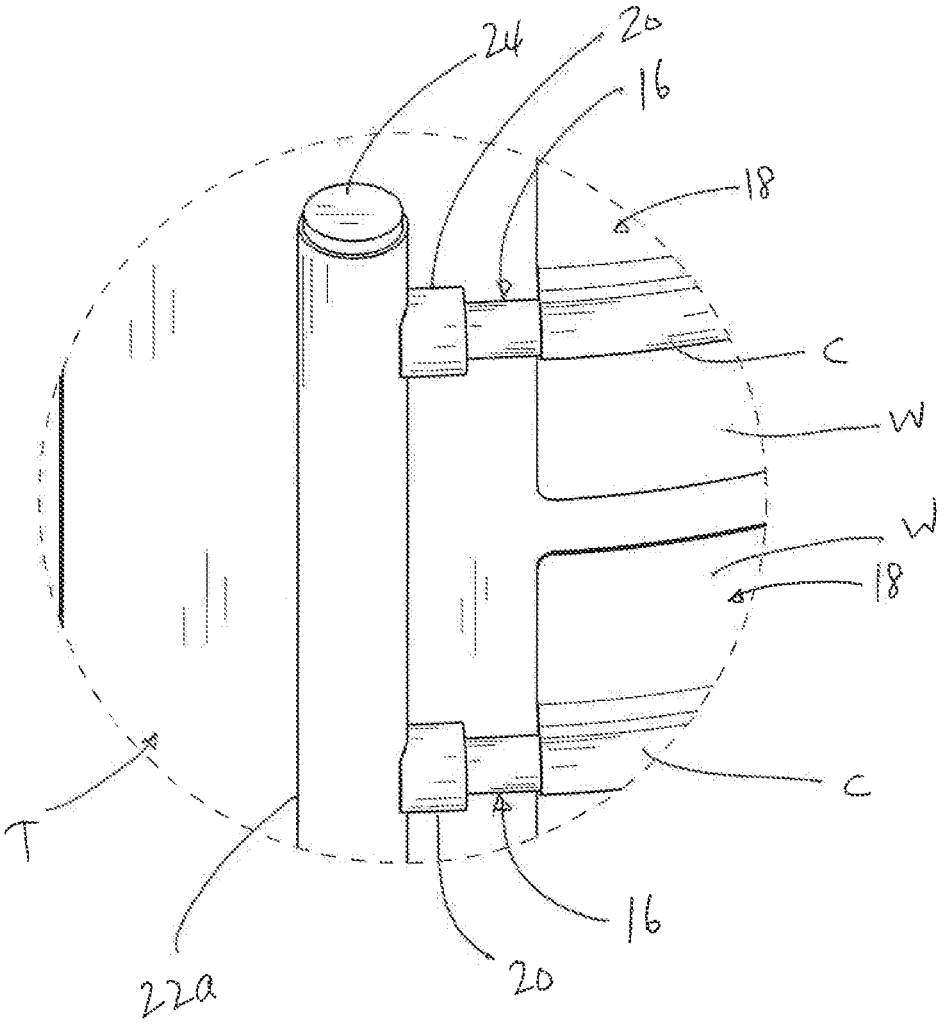
FIG. 4 is an enlarged partial isometric view with reference to line 4-4 of FIG. 1.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected," "attached," or terms similar thereto are often used. They are not limited to direct connection or attachment, but include connection or attachment to other elements where such connection or attachment is recognized as being equivalent by those skilled in the art.

DETAILED DESCRIPTION

The various features and advantageous details of the subject matter disclosed herein are explained more fully with reference to the non-limiting embodiments described in detail in the following description.

A heat exchange arrangement 10 in accordance with the present invention is adapted for use in combination with a vessel, such as a tank T. The heat exchange arrangement 10 is of the external type, in which heat exchange takes place between the walls of tank T and heat exchange arrangement 10, as opposed to an internal heat exchange arrangement in which heat exchange takes place by direct interaction with fluid contained within a vessel such as tank T.

The heat exchange arrangement 10 includes an inlet manifold 12, an outlet manifold 14, and a series of heat exchange tubes in the form of ribs 16. A heat exchange enhancer arrangement, which may be in the form of a series of heat exchange enhancer plates 18, overlies the ribs 16. In the illustrated embodiment, each rib 16 lies in a plane and is positioned adjacent the outer wall of the tank T, and the planes within which ribs 16 lie are generally parallel to each other and perpendicular to a longitudinal axis A along which the tank T extends. Alternatively, the ribs 16 may be oriented so as to sloped downwardly between inlet manifold 12 and outlet manifold 14, in order to facilitate liquid drainage toward the outlet manifold 14. In a configuration such as this, the ribs 16 lie in planes that are parallel to each other but are non-perpendicular to the longitudinal axis A of the tank T.

The inlet manifold 12, outlet manifold 14 and ribs 16 have a construction that enables the flow of fluid therethrough, and representatively may be in the form of tube or pipe members. The tube or pipe members may have any satisfactory cross section, and representatively may be circular in cross section. Any or all of the tube or pipe members of inlet manifold 12, outlet manifold 14 and/or ribs 16 may alternatively have any other desired cross-sectional shape, such as but not limited to an oval cross-section or a D-shaped or square cross-section, which provide a flat area of contact with the of a tank T to facilitate heat transfer.

In the illustrated embodiment, the tank T may have any satisfactory cross section, and in the illustrated embodiment has a circular cross section. It is understood, however, that the vessel in connection with which the heat exchange arrangement 10 is employed may have any shape or cross section.

The inlet manifold 12 may be oriented so as to extend in a direction generally parallel to the longitudinal axis A of the tank T. The inlet manifold 12 may be positioned against the exterior surface of the wall of tank T, so as to facilitate the transfer of heat therebetween. In a generally similar manner, the outlet manifold 14 may be oriented so as to extend in a direction generally parallel to the longitudinal axis A of the tank T. The outlet manifold 14 may also be positioned against the exterior surface of the wall of tank T, so as to facilitate the transfer of heat therebetween.

An adaptor, such as shown at 20, may be positioned between the end of each rib 16 and the inlet manifold 12, as well as between the opposite end of each rib 16 and the outlet manifold 14. The adaptors 20, ribs 16, inlet manifold 12 and outlet manifold 14 are constructed so as to allow fluid to flow freely from the inlet manifold 12 to the outlet manifold 14. The adaptors 20 are utilized to provide strength for smaller diameter tube and manifold sizes, but may not be needed for other designs. For example, with larger tube and manifold sizes, saddle welds may provide sufficient strength.

In the illustrated embodiment, the outlet manifold 14 has a generally U-shaped construction, including a first outlet manifold member 22*a*, a second outlet manifold member 22*b*, and a curved outlet manifold section 22*c* extending between and interconnecting the lower ends of the first outlet manifold member 22*a* and the second outlet manifold member 22*b*. Representatively, the outlet manifold 12 may be formed of a one-piece section of tube or pipe formed with a U-bend. A cap 24 seals the upper end of the outlet manifold member 22*a*, and a cap 24 also seals the lower end of the inlet manifold 12. The curved outlet manifold section 22*c* defines the lowermost extent of the heat exchange arrangement 10, and serves as a trap for any condensation or liquid that may be contained within the fluid that flows through the heat exchange arrangement 10. A suitable valve or tube (not shown) may be fitted to the lower end of curved outlet manifold section 22*c* so as to enable any such condensation or liquid to be drained and/or for other various purposes, such as but not limited to connecting a heat exchange arrangement 10 in parallel with one or more additional heat exchange systems.

The heat exchange enhancer plates 18 may be configured such that each heat exchange enhancer plate 18 overlies one of the ribs 16. In one configuration, the heat exchange enhancer plates 18 may be in the form of full-length enhancer plates 18 as illustrated, in which a single enhancer plate 18 overlies a majority of the length of each rib 16 between the inlet manifold 22 and the first outlet manifold member 22*a*. Alternatively, the heat exchange enhancer plates 18 may be in the form of partial-length enhancer plates, in which two or more partial enhancer plates overlie a majority of the length of each rib 16 between the inlet manifold 22 and the first outlet manifold member 22*a*. In yet another configuration, the heat exchange enhancer plates 18, instead of being separately formed horizontal members that overlie the ribs 16, may be constructed of one or more vertical members in which each enhancer plate is formed to overlie some or all of the ribs 16 along its height. In any such configuration, the enhancer plates 18 define walls such as W on either side of a channel C. The walls W have a radius that matches that of the outer wall of the tank T, such that the walls W contact the tank outer wall throughout the length of the walls W. The channel C has a radius that matches that of the outside diameter of each rib 16, such that the wall of the channel C contacts the rib 16 throughout the length of the enhancer plate 18. The ribs 16 and heat exchange enhancer plates 18 are formed and assembled onto tank T so as to provide maximal intimate contact of the ribs 16 and inside surfaces of enhancer plates 18 with the outer surface of tank T.

As noted above, while the heat exchange enhancer arrangement is shown and described as a series of individual heat exchange enhancer plates 18, one for each rib 16, it is understood that alternative configurations may be utilized. For example, and without limitation, a heat exchange enhancer plate may have multiple channels C so as to overlie any number of ribs 16 or, in another version, a single heat exchange enhancer plate may be provided with all of the channels C required to overlie all the ribs 16.

In assembly, the heat exchange arrangement 10 is constructed and assembled such that the inlet manifold 12 and outlet manifold 14 are positioned against the outer wall of the tank T. The ribs 16 are also positioned against the outer wall of the tank T, and the heat exchange enhancer plates 18 are assembled over the ribs 16 such that the heat exchange enhancer plate walls W are engaged against the outer wall of the tank T and the wall of the channel C is engaged against the outer wall of the rib 16. Assembly may take place in any satisfactory manner, such as but not limited to by welding, straps, etc. If desired, a heat transfer paste, often referred to as thermal mastic, may be applied between the tank walls and the inlet manifold 12, outlet manifold 14, ribs 16 and/or heat exchange enhancer plates 18 to bridge any air gaps that may be present in order to facilitate heat transfer.

In operation a heat transfer fluid, such as superheated pressurized CO2 refrigerant or any other satisfactory heat exchange medium, flows into the inlet manifold 12, through the ribs 16 and out the outlet manifold 14. Heat is transferred to the walls of the tank T from the refrigerant by conduction through contact of the ribs 16 with the outer wall of the tank T. In addition, and when the optional heat enhancers 18 are present, heat is conducted from the ribs 16 to the heat enhancer channels C, to the heat enhancer walls W, then to the walls of the tank T. Heat is then transferred to the fluid or medium in the tank T via the walls of tank T. In the event tank T is intended to heat potable water, the wall of the tank T and the walls of ribs 16 create the required double-wall separation between the water contained within tank T and the fluid contained within ribs 16.

The construction of the heat exchange arrangement 10 is such that a refrigerant, such as CO2, subjected to very high pressures can be allowed to safely flow through the heat exchange arrangement 10. In this regard, the connection of the ribs 16 to the inlet manifold 12 and the outlet manifold 14, using adaptors 20 and simple weld connections, provides the ability of the heat exchange arrangement 10 to withstand high pressures. The use of pipe or tubing for the manifolds and ribs allows a designer to select wall thicknesses capable of withstanding high pressures. With the use of heat exchange enhancer plates 18, a substantial majority of the surface area of the outer wall of tank T can be utilized to transfer heat from the refrigerant fluid.

At the inlet manifold 12, it is expected that the working fluid or refrigerant is a high temperature, high-pressure superheated gas, such as CO2, that is typically supplied from the discharge of a compressor. The fluid, such as water, contained within tank T will be cooler, and heat transfer will occur from the refrigerant within the heat exchange arrangement 10 to the water in tank T. Phase change of the working fluid may or may not occur as the working fluid flows through the heat exchange arrangement 10. The design of heat exchange arrangement 10 accommodates either situation, i.e., whether or not phase change of the working fluid occurs. The design of heat exchange arrangement 10 also accommodates other types of lower pressure working fluids or refrigerants, whether natural or synthetic.

The ribbed configuration of the heat exchange arrangement 10 also provides the ability to utilize ribs having different radii, such as in the event the tank T has a non-uniform diameter throughout its height. For example, it is common for a tank to have a radius at the top and bottom that is slightly larger than the diameter of the tank therebetween, which may result from the specific construction and assembly of the tank (for example there may be circumferential welds at the top and bottom of the tank). In a case such as this, the top and bottom ribs of the heat exchange arrangement 10 may be formed with a slightly larger radius than the ribs therebetween, to ensure that intimate contact can be maintained between the ribs and the tank wall.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A heat exchange arrangement, comprising:

a vessel having an outer wall defining an interior volume within which a first fluid is contained, wherein the vessel defines a longitudinal axis;

an inlet manifold;

an outlet manifold;

a series of heat exchange tubes extending between and fluidly connected to the inlet manifold and the outlet manifold, wherein a second fluid is adapted to flow through the inlet manifold, the outlet manifold and the heat exchange tubes, wherein each heat exchange tube lies in a plane and is configured to be positioned adjacent the outer wall of the vessel, wherein the planes within which the heat exchange tubes lie are generally parallel to each other; and a series of heat exchange members, wherein each heat exchange member has a shape that is configured to match a shape of the outer wall of the vessel and to overlie at least one of the heat exchange tubes and is adapted to be positioned against the outer wall of the vessel, whereby heat is adapted to be transferred between the first fluid and the second fluid through the outer wall of the vessel, the heat exchange members and the heat exchange tubes.

2. The heat exchange arrangement of claim 1, wherein the inlet manifold and the outlet manifold are configured to be generally parallel to the longitudinal axis of the vessel.

3. The heat exchange arrangement of claim 1, wherein the vessel defines a generally circular cross section, and wherein each heat exchange member has a generally arcuate configuration defining a pair of spaced apart ends.

4. The heat exchange arrangement of claim 3, wherein the heat exchange tubes are configured to extend about a majority of a periphery defined by the vessel, and wherein the inlet tube and the outlet tube are positioned adjacent each other when the heat exchange tubes are positioned about the vessel.

5. A heat exchange arrangement, comprising:

a vessel having an outer wall defining an interior volume within which a first fluid is contained, wherein the vessel defines a longitudinal axis;

an inlet manifold tube;

an outlet manifold tube;

a series of heat exchange tubes, each of which extends between and is fluidly connected to the inlet manifold tube and the outlet manifold tube, wherein a heat exchange fluid is adapted to flow from the inlet manifold tube and through the heat exchange tubes to the outlet manifold tube, wherein each heat exchange tube lies in a plane and is configured to be positioned adjacent the outer wall of the vessel, wherein the planes within which the heat exchange tubes lie are generally parallel to each other; and a series of heat exchange members, wherein each heat exchange member has a shape that is configured to match a shape of the outer wall of the vessel and is adapted to overlie at least one of the heat exchange tubes and is configured to be positioned against the outer wall of the vessel;

wherein the heat exchange tubes and the heat exchange members are configured to extend about a majority of a periphery defined by the vessel.

6. The heat exchange arrangement of claim 5, wherein the inlet manifold tube and the outlet manifold tube are generally parallel to the longitudinal axis of the vessel.

7. The heat exchange arrangement of claim 5, wherein the inlet tube and the outlet tube are positioned adjacent each other.

8. The heat exchange arrangement of claim 5, wherein the vessel defines a generally circular cross section, and wherein each heat exchange member has a generally arcuate configuration defining a pair of spaced apart ends.

9. The heat exchange arrangement of claim 8, wherein each heat exchange member includes a channel and a pair of walls extending in opposite directions from the channel, wherein one of the heat exchange tubes is received within the channel and wherein the pair of walls are configured to be engaged against the outer wall of the vessel.

* * * * *